US012270262B2

(12) United States Patent
Mackay et al.

(10) Patent No.: US 12,270,262 B2
(45) Date of Patent: Apr. 8, 2025

(54) FLOAT EQUIPMENT FOR USE WITH COMPOSITE CASING OR LINER STRING

(71) Applicant: DOWNHOLE PRODUCTS LIMITED, Aberdeen (GB)

(72) Inventors: Alexander Craig Mackay, Aberdeen (GB); Douglas Farley, Missouri City, TX (US)

(73) Assignee: DOWNHOLE PRODUCTS LIMITED

( * ) Notice: Subject to any disclaimer, the term of this patent is extended or adjusted under 35 U.S.C. 154(b) by 0 days.

(21) Appl. No.: 18/310,566

(22) Filed: May 2, 2023

(65) Prior Publication Data

US 2023/0399899 A1 Dec. 14, 2023

Related U.S. Application Data

(60) Provisional application No. 63/351,107, filed on Jun. 10, 2022.

(51) Int. Cl.

| | |
|---|---|
| ***E21B 34/06*** | (2006.01) |
| ***E21B 17/16*** | (2006.01) |
| ***E21B 21/10*** | (2006.01) |

(52) U.S. Cl.

CPC ..... *E21B 17/16* (2013.01); *E21B 21/10* (2013.01); *E21B 34/063* (2013.01)

(58) Field of Classification Search

CPC ..... E21B 33/14; E21B 17/14; E21B 17/16; E21B 33/13; E21B 34/08; E21B 34/06; E21B 21/10; F16K 1/38; F16K 27/0209; F16K 15/026

See application file for complete search history.

(56) References Cited

U.S. PATENT DOCUMENTS

| | | | | |
|---|---|---|---|---|
| 6,457,517 | B1 | 10/2002 | Goodson | |
| 6,513,598 | B2 | 2/2003 | Moore | |
| 7,428,927 | B2 | 9/2008 | Vert | |
| 7,730,965 | B2 | 6/2010 | Jordan | |
| 8,622,126 | B2 | 1/2014 | Scott | |
| 9,074,430 | B2 | 7/2015 | Levie | |
| 9,291,007 | B2 * | 3/2016 | Darbe | E21B 17/14 |
| 9,506,318 | B1 | 11/2016 | Brunet | |
| 10,221,632 | B2 | 3/2019 | Macdonald | |
| 10,428,584 | B2 | 10/2019 | Thigpen | |
| 10,760,355 | B2 | 9/2020 | Farley | |
| 10,961,845 | B2 | 3/2021 | Roberson | |
| 2007/0246224 | A1 * | 10/2007 | Krauss | E21B 33/1204 166/376 |
| 2022/0154553 | A1 * | 5/2022 | Giroux | E21B 34/14 |

* cited by examiner

*Primary Examiner* — Yong-Suk (Philip) Ro

(57) ABSTRACT

A float collar for assembly with a composite string of downhole tubulars includes: a tubular housing made from a composite material and having couplings formed at longitudinal ends thereof; a float valve disposed in a bore of the housing; a sheath connecting the float valve to the housing and sealing an interface between the float valve and the housing; and a guide operable to prevent side-tracking of a drill bit into the housing while drilling out the float valve and the sheath.

7 Claims, 7 Drawing Sheets

FLOAT EQUIPMENT FOR USE WITH COMPOSITE CASING OR LINER STRING

BACKGROUND OF THE DISCLOSURE

Field of the Disclosure

The present disclosure generally relates to float equipment for use with a composite casing or liner string.

Description of the Related Art

U.S. Pat. No. 6,457,517 discloses a composite landing collar which is preferably adhesive bonded to the liner string using a high temperature epoxy. The spacing during bonding is maintained within dimensional limits using spacers. The body features a bi-directional material, with an appropriate ratio in the warp and fills directions, for about a quarter of the wall thickness. A unidirectional material with the fibers axially aligned aids in reduction of thermal stresses in the thick wall during curing, as well as reducing shear stress concentration along the adhesive bonding interface.

U.S. Pat. No. 6,513,598 discloses a one trip method for drilling a wellbore below a cemented casing is disclosed. An apparatus for use in performing the method is also disclosed. The method includes lowering a drill bit into a casing cemented in the wellbore. The casing has float equipment connected therein. The drill bit is rotated in the casing above the float equipment so that it expands radially outwardly to a diameter greater than the inner diameter of the casing. The float equipment, which can be a float shoe or a float collar or any other type of float equipment known in the art, includes an outer case with a valve connected therein. The outer case is comprised of a drillable material. Thus, the drill bit utilized to drill the wellbore can begin its drilling operation above the float equipment and successfully drill a wellbore below the casing having a diameter greater than the inner diameter of the casing.

U.S. Pat. No. 7,428,927 discloses a cement float collar made for pumping downhole and into engagement with a groove formed in the casing, called the profile nipple. As such, no restriction is needed in the casing for accepting or latching the float collar and the portion of casing including the groove can be installed at the start of the drilling operation. In addition, the profile nipple can be used to engage other drilling tools and, therefore, can already be in place when the final well depth (TD) is reached.

U.S. Pat. No. 7,730,965 discloses an improved method and/or apparatus for completing a wellbore. In one embodiment, a method of lining a pre-drilled wellbore is provided. The method includes the act of providing a casing assembly, the casing assembly including a string of casing; and a retractable joint comprising an inner tubular and an outer tubular. The method further includes the acts of running the casing assembly into the pre-drilled wellbore and actuating the retractable joint, thereby reducing the length of the casing assembly through movement between the inner and outer tubulars.

U.S. Pat. No. 8,622,126 discloses a reaming shoe for location in a bore having a rotationally balanced nose. A rotary drive is rotationally coupled to the reaming shoe to enable reaming of the bore. The assembly of the reaming shoe and the rotary drive is adapted to be coupled to a tubular component. The reaming shoe is mounted to the tubular component to enable rotation of the reaming shoe independently of the tubular component, such that the reaming shoe is rotatable at a different rotational speed than the tubular component.

U.S. Pat. No. 9,074,430 discloses a tubular component including a limit collar disposed about the tubular component, and the limit collar includes a body portion comprising a plurality of upsets disposed on an inner surface of the body portion, wherein the plurality of upsets define a first ring, a second ring, and at least one rib, at least one chamber formed between the inner surface of the body portion, an outer surface of the tubular component, and one or more surfaces of the first ring, the second ring, or the at least one rib, and a binder portion disposed in the at least one chamber.

U.S. Pat. No. 9,506,318 discloses a method and system of cementing a well bore with vibration of a casing string as a fluid cement mixture is forced into the annulus between the casing string and the well bore as a curable fluid cement mixture is pumped through the casing string. A casing shoe and/or a casing collar have a vibration-inducing mechanism for vibrating the shoe casing radially in response to the flow of fluid through the casing.

U.S. Pat. No. 10,221,632 discloses a non-conductive composite insert between conductive portions, useful, for example, in downhole EM telemetry applications as an external "gap sub" in a drill collar, or as a sonde-based internal gap. In a preferred embodiment, the composite is made from a glass-fiber reinforced plastic, and separates non-magnetic conductive portions made from stainless steel. The composite insert provides a slanted or tapered transition into the conductive portions at either or both ends of the insert. The transitions on the composite insert may comprise one or more tapered surfaces, which may be male or female in configuration with respect to matching transitions on the conductive portions. The transitions may be bonded together by adhesive, or alternatively may be threaded.

U.S. Pat. No. 10,428,584 discloses a bit for drilling with a casing or liner string including: a tubular stem made from a high strength metal or alloy; a head: having a cutting face with an inner cone, an outer shoulder, and an intermediate nose between the cone and the shoulder; attached to an end of the stem; and made from a nonferrous metal or alloy; a plurality of blades formed integrally with the head, made from the nonferrous metal or alloy, and each extending from a center of the cutting face to the shoulder; a plurality of superhard cutters mounted along each blade; a plurality of gauge pads formed integrally with the stem; and a flush joint formed between each blade and a respective gauge pad. A yield strength of the high strength metal or alloy is at least twice a yield strength of the nonferrous metal or alloy.

U.S. Pat. No. 10,760,355 discloses a float shoe for a downhole tubular or casing including a housing, a nose, a support, and a valve. The housing is attached to the casing, and the nose having a shell of a millable material (e.g., composite, aluminum, etc.) extends from the housing. A support of cement, fills an internal cavity of the nose's shell and support a valve in the housing. The shell for the nose defines a flow passage communicating with the valve and can have a conical or eccentric shape to facilitate passage of the float shoe in a borehole during run-in. The shell for the nose can also have a port or jet that communicate the flow passage out the side of the nose.

U.S. Pat. No. 10,961,845 discloses a communication unit situated in or on a casing collar. The casing collar has two threaded ends for joining casing joints to construct a well casing, and a communication unit is disposed in or on a central region of the tube between the two threaded ends. In an example, the communication unit has a transmitter for transmitting sensor data uphole from a sensor sensing a well bore condition. For example, the communication unit has a receiver for receiving sensor data from Micro-Electro-Mechanical Systems (MEMS) sensors, a transceiver for interrogating RFID tags, an acoustic transceiver for sensing wellbore conditions, a pressure sensor, a temperature sensor, and batteries for powering the communication unit

SUMMARY OF THE DISCLOSURE

The present disclosure generally relates to float equipment for use with a composite casing or liner string. In one embodiment, a float collar for assembly with a composite string of downhole tubulars includes: a tubular housing made from a composite material and having couplings formed at longitudinal ends thereof; a float valve disposed in a bore of the housing; a sheath connecting the float valve to the housing and sealing an interface between the float valve and the housing; and a guide operable to prevent side-tracking of a drill bit into the housing while drilling out the float valve and the sheath.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
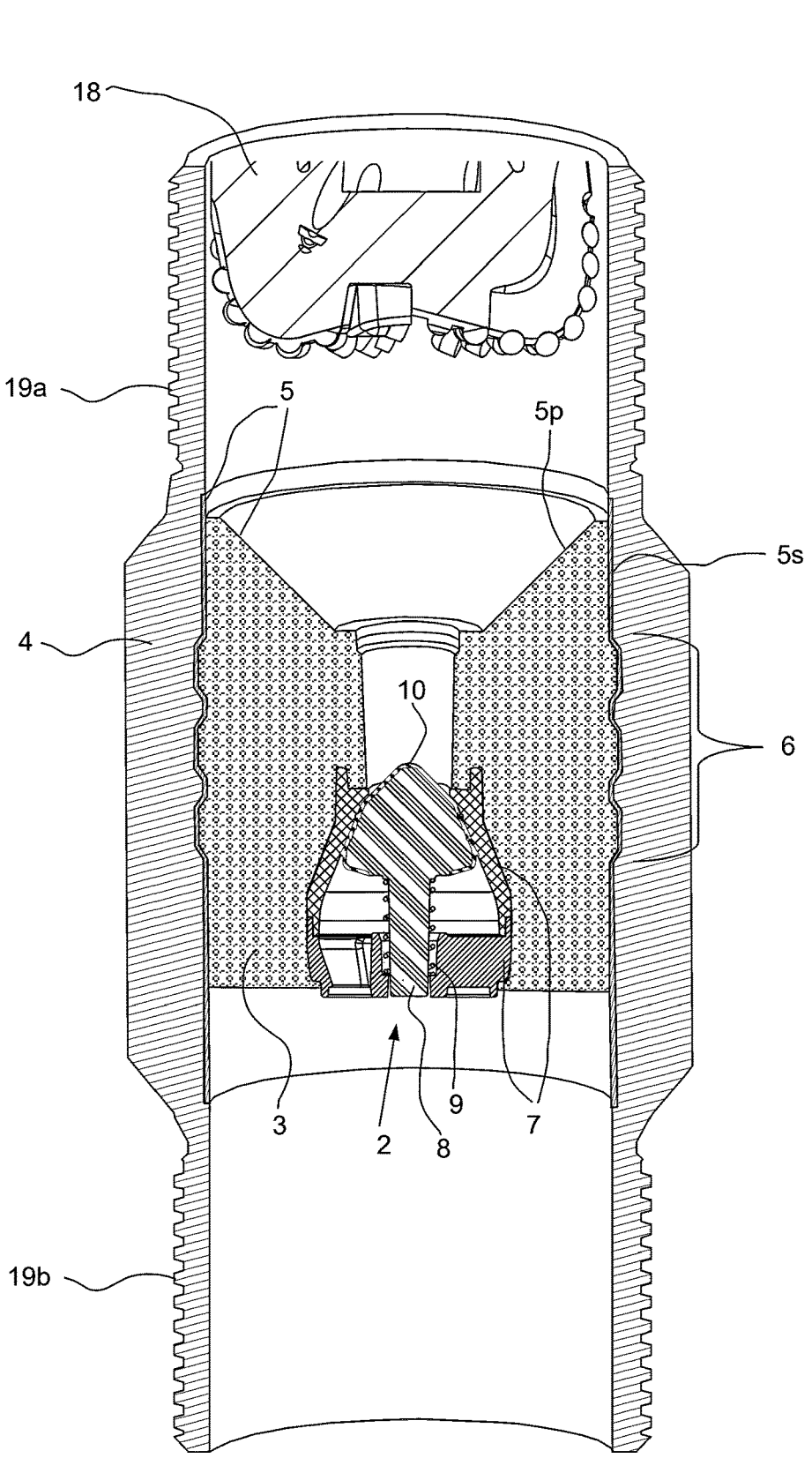
FIG. 1 illustrates a float collar for assembly as part of a composite casing or liner string, according to one embodiment of the present disclosure.
Figure 2A:
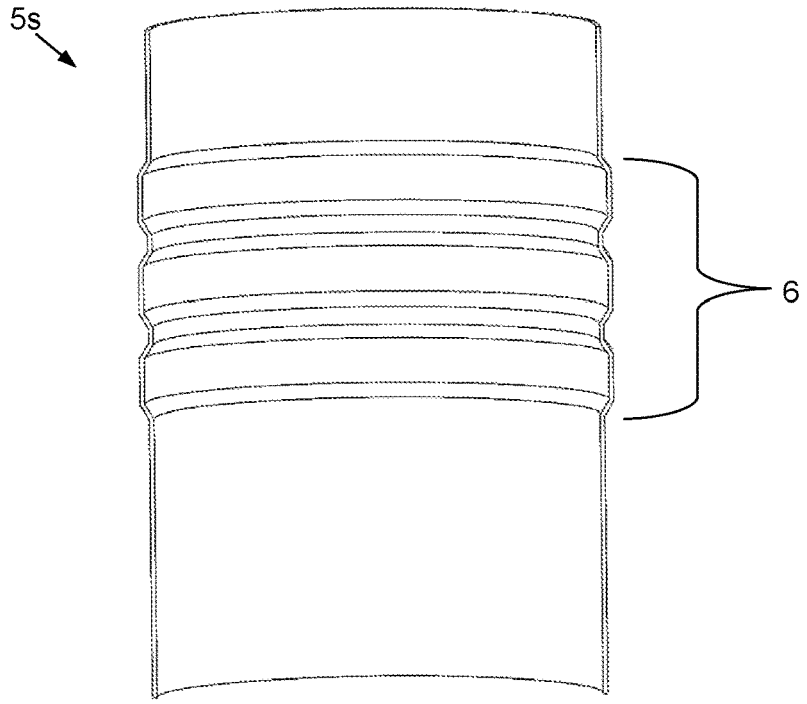
FIG. 2A illustrates a portion of a guide of the float collar.

FIG. 1 illustrates a float collar 1 for assembly as part of a composite casing or liner string, according to one embodiment of the present disclosure. FIG. 2A illustrates a portion of a guide 5 of the float collar 1. The float collar 1 may include a float valve 2, a sheath 3, a housing 4, and the guide 5. The guide 5 may include a profile 5*p* formed in the sheath 3 and a shield 5*s* bonded to the housing 4. The housing 4 may be tubular and may have a coupling (not shown) formed at each longitudinal end thereof, such as a threaded pin 19*a,b* or box, for assembly as part of the composite casing or liner string.

The float collar 1 may be assembled at a lower portion of the composite casing or liner string. The housing 4 may have an array of groves 6 formed in and along an inner surface thereof to facilitate bonding with the sheath 3. The housing 4 may be made from a composite material, such as a fiber reinforced polymer. The float valve 2 and sheath 3 may be made from materials drillable by a polycrystalline diamond compact (PDC) drill bit, such as a nonferrous material. By nonferrous, it is meant that the material contains no more than a trace amount of iron. The guide shield 5*s* may be metallic, such as being made from a metal or alloy, such as steel, which may also be non-drillable. Coincidentally, the composite material of the housing 4 may also be drillable.

The guide shield 5*s* may be a sleeve and have the cement grooves 6 formed in a wall thereof. The guide shield 5*s* may have a length greater than or equal to a length of the sheath 3. The guide shield 5*s* may extend along the entire interface between the sheath 3 and the housing 4 so that the sheath does not directly interface with the housing. The guide shield 5*s* may be bonded to the housing 4 by being pre-formed and placed over the winding mandrel used to form the housing so that the guide shield forms a recess within the inner surface of the housing 4 and also forms the cement grooves 6 within the housing.

The sheath 3 may be made from cement, such as Portland cement or Portland cement concrete. The sheath 3 may bond the float valve 2 to the guide shield 5*s* within a flow bore of the housing 4. The sheath 3 may also seal the interface between the float valve 2 and the guide shield 5*s* to prevent fluid bypass of the float valve 2. The sheath 3 may surround the float valve 2 and have a flow bore formed through a portion thereof and in fluid communication with an upper end port of the float valve 2 and with the flow bore of the housing 4. The float valve 2 may be located in a lower portion of the sheath 3 such that one or more lower end ports of the float valve are exposed to the flow bore of the housing 4. The guide profile 5*p* may be frusto-conical and may be formed in and extend from a top of the sheath 3 to guide a drill bit 18 for drill-out of the float valve 2 and sheath 3. The guide shield 5*s* may prevent the drill bit 18 from side-tracking into the composite housing 4 while drilling out the sheath 3 and the float valve 2. A landing profile may be formed at an interface between the guide profile 5*p* and the flow bore of the sheath 3 for receiving a wiper plug (not shown).

Alternatively, an autofill float valve may be used instead of the float valve 2. Alternatively, the guide shield 5*s* may be omitted.

The float valve 2 may include a body 7, a valve member, such as a poppet 8 (a.k.a. plunger), and a biasing member, such as compression spring 9. The body 7 may be made from a polymer, such as a thermoplastic, thermoset, or copolymer. The body 7 may include an upper section and a lower section which may be connected together by a lap joint and secured, such as by adhesive or threads. The poppet 8 may have an upper head portion and a lower stem portion.

The upper body section may be frusto-conical and have a valve chamber formed therein for receiving the poppet head. An outer surface of the upper body section may have recesses formed therein to facilitate bonding with the sheath 3 in a torsional manner. An inner shoulder may be formed adjacent a top of the upper body section 9 to facilitate bonding with the sheath 3 in a longitudinal manner. The upper end port of the float valve 2 may be formed adjacent the top of the upper body section and may be in fluid communication with the valve chamber. The valve chamber may extend from the upper end port of the float valve 2 along an inner surface of the upper body section and through to a lower end thereof. The valve chamber may diverge from the upper end port of the float valve 2 to a lower end of the upper body section except for straight portions at the interfaces with the upper end port and the lower end.

The lower body section may have a plurality of portions, such as an outer rim, an inner hub, and one or more (two shown) ribs connecting the rim and the hub. The lower end ports of the float valve 2 may be formed between the ribs of the lower body section and may be in fluid communication with the valve chamber. An outer surface of the lower body section may have recesses formed therein adjacent to a bottom thereof to facilitate bonding with the sheath 3 in a longitudinal and torsional manner. The hub of the lower body section may have a passage formed therethrough for receiving the poppet stem. A spring chamber may be formed in an upper portion of the hub of the lower body section adjacent to the passage for receiving the spring 9. A spring shoulder may be formed at a bottom of the spring chamber of the lower body section.

The poppet 8 may be made from any of the materials of the body 7, discussed above. The poppet head may be conical and may carry a valve seal 10 on an outer surface thereof. The valve seal 10 may be made from an elastomer or elastomeric copolymer and may be mounted to the poppet head, such as by being molded thereon. The poppet 8 may be longitudinally movable relative to the body 7 between an open position (not shown) and a closed position (shown). The poppet head may have a stop shoulder formed in a bottom thereof and a spring shoulder formed at an interface with the poppet stem. In the open position, the stop shoulder of the poppet head may engage a top of the hub of the lower body section.

The spring 9 may have an upper end bearing against the spring shoulder of the poppet head and a lower end bearing against the spring shoulder of the hub of the lower body section, thereby biasing the poppet 8 toward the closed position. The spring 9 may be made from a non-ferrous metal or alloy. The poppet stem may extend through the hub passage of the lower body section. A portion of the hub passage may serve as a guide for the poppet stem and a clearance fit, such as a sliding fit or close running fit, may be formed between an outer surface of the poppet stem and the inner surface of the hub of the lower body section.

Alternatively, any of the components of the float valve 2 except the valve seal 10 may be made from any of the materials discussed above for the spring 7.

In operation, the float collar 1 may be assembled as part of the composite casing or liner string and deployed into a wellbore (not shown). Once the composite casing or liner string has landed in the wellbore, conditioner fluid (not shown) may be pumped down the bore of the composite casing or liner string. The conditioner fluid may be pumped into the composite casing or liner string via a cementing head (not shown) connected to a top of the composite casing or liner string at a drilling rig at a surface of the earth or the sea. Pumping of the conditioner fluid may create a differential pressure across the poppet head, thereby moving the poppet 8 downward to the open position. Cement slurry and one or more wiper plugs may be pumped through the bore of the composite casing or liner string until the cement slurry has been pumped into an annulus formed between the composite casing or liner string and the wellbore. Once the cement slurry has been placed, the float valve 2 may close to prevent the cement slurry from U-tubing back into the bore of the composite casing or liner string. The lack of any downward pumping through the float valve 2 may remove any pressure differential across the poppet 8, thereby allowing the spring 9 to move the poppet upwardly until the valve seal 10 carried by the poppet head engages a mating valve seat formed in an inner surface of the upper housing section, thereby sealing the valve chamber of the float valve from upward flow there-through. Once the cement slurry has cured, the float valve 2 and sheath 3 may be drilled out such that the wellbore may be further extended.

Figure 2B:
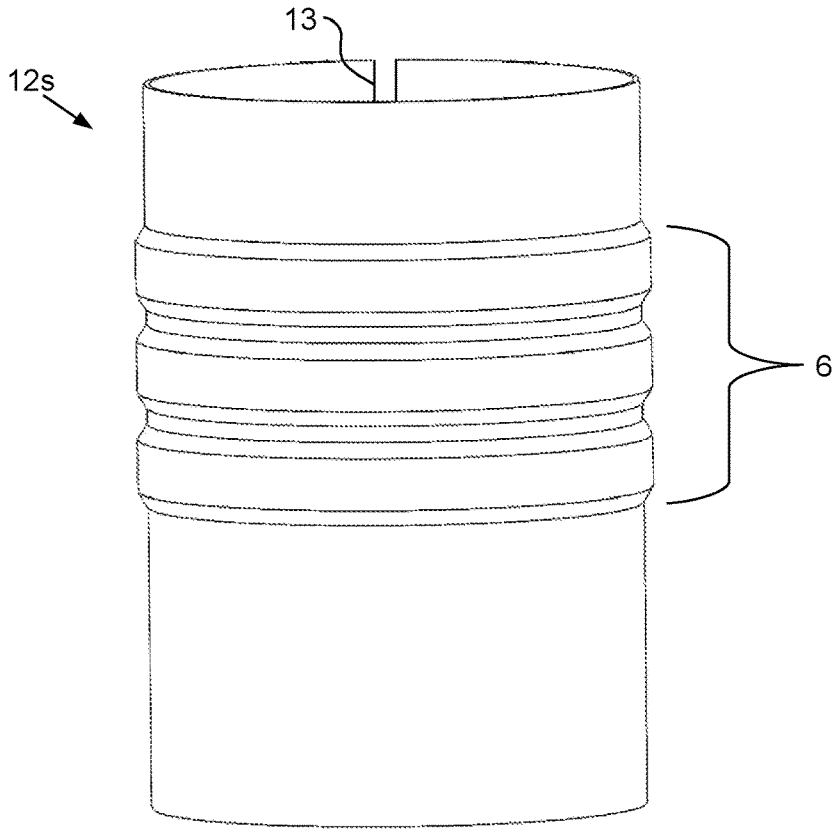
FIG. 2B illustrates a portion of a guide of a second float collar.
Figure 3:
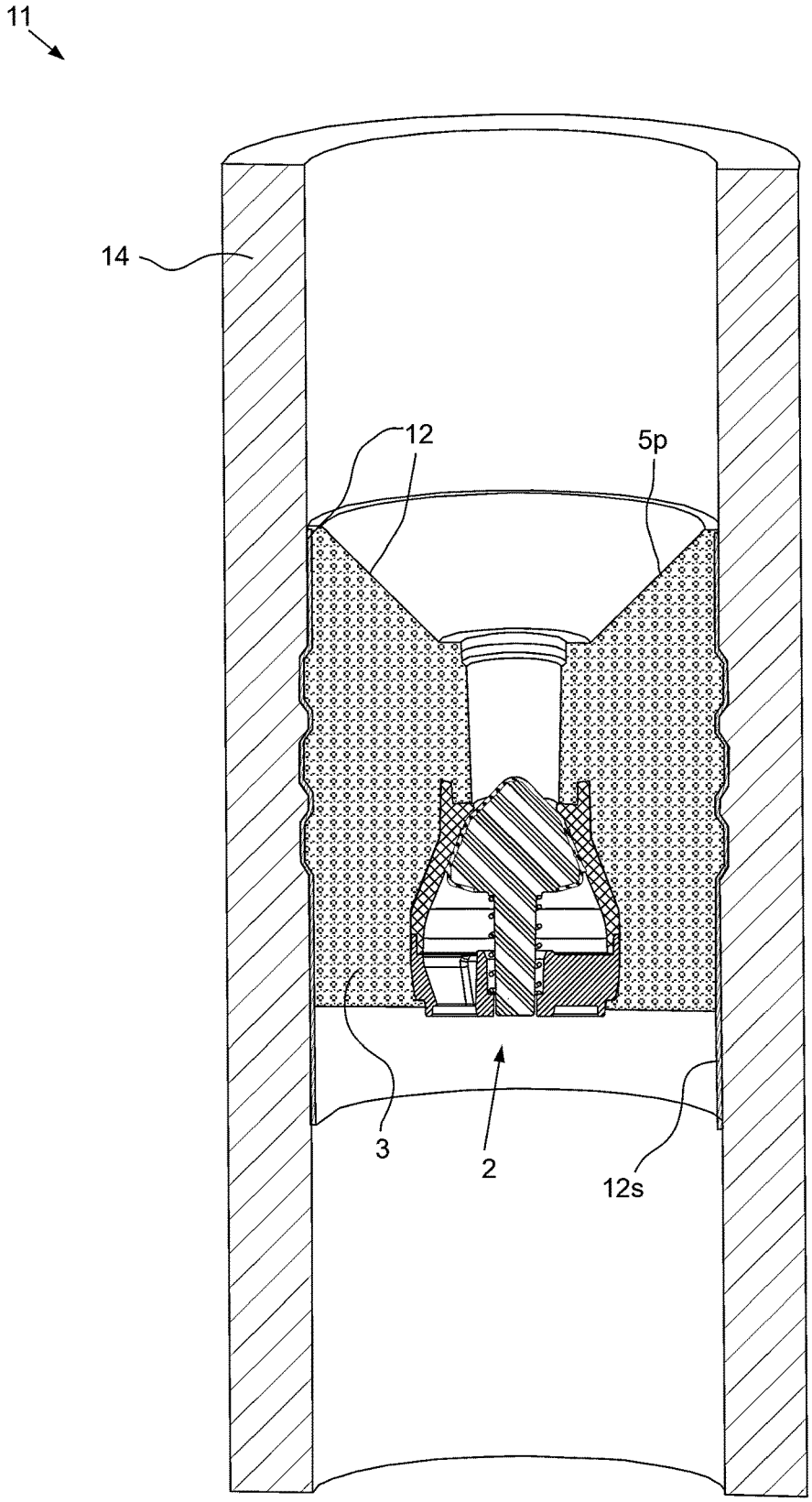
FIG. 3 illustrates the second float collar for assembly as part of the composite casing or liner string, according to another embodiment of the present disclosure.

FIG. 3 illustrates the second float collar 11 for assembly as part of the composite casing or liner string, according to another embodiment of the present disclosure. FIG. 2B illustrates a portion of a guide 12 of the second float collar 11. The second float collar may be similar or identical to the (first) float collar 1 except for having the second guide 12 instead of the (first) guide 5 and having a second housing 14 instead of the (first) housing 4. The second guide 12 may include the guide profile 5*p* and a shield 12*s*. The second housing 14 may be similar or identical to the first housing 4 except for not being formed with the second guide shield 12*s*. The second guide shield 12*s* may be made from any of the materials discussed above for the first guide shield 5*s*. The second guide shield 12*s* may be a split sleeve and have the cement grooves 6 formed in a wall thereof. The split 13 may be formed through and along a wall of the second guide shield 12*s* such that the second guide shield 12*s* may be compressed for insertion into the bore of the second housing and, once placed, may be released into engagement with the cement grooves 6 thereof. The second guide shield 12*s* may be radially movable between an expanded position (shown) and a retracted position (not shown) and may be naturally biased toward the expanded position. To secure the second guide shield 12*s* into place, a polymer adhesive may be applied to an outer surface thereof before insertion into the second housing 14. The second guide shield 12*s* may have a length greater than or equal to a length of the sheath 3. The second guide shield 12*s* may extend along the entire interface between the sheath 3 and the second housing 14 so that the sheath does not directly interface with the housing (except for a negligible portion at the split 13).

Alternatively, the second guide shield 12*s* may include a plurality of segments instead of being split.

Figure 4:
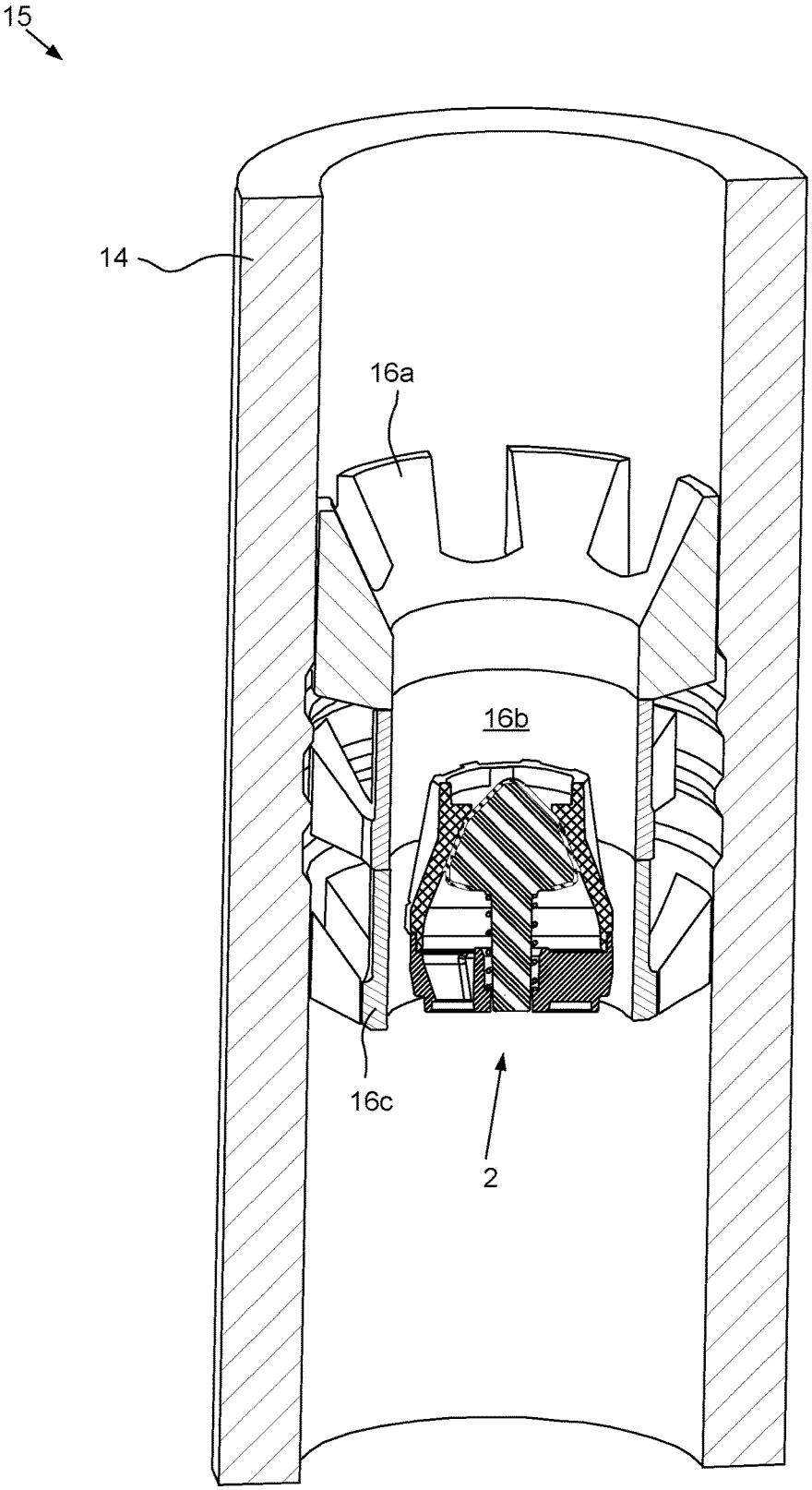
FIGS. 4 and 5 illustrate a third float collar for assembly as part of the composite casing or liner string, according to another embodiment of the present disclosure.
Figure 5:
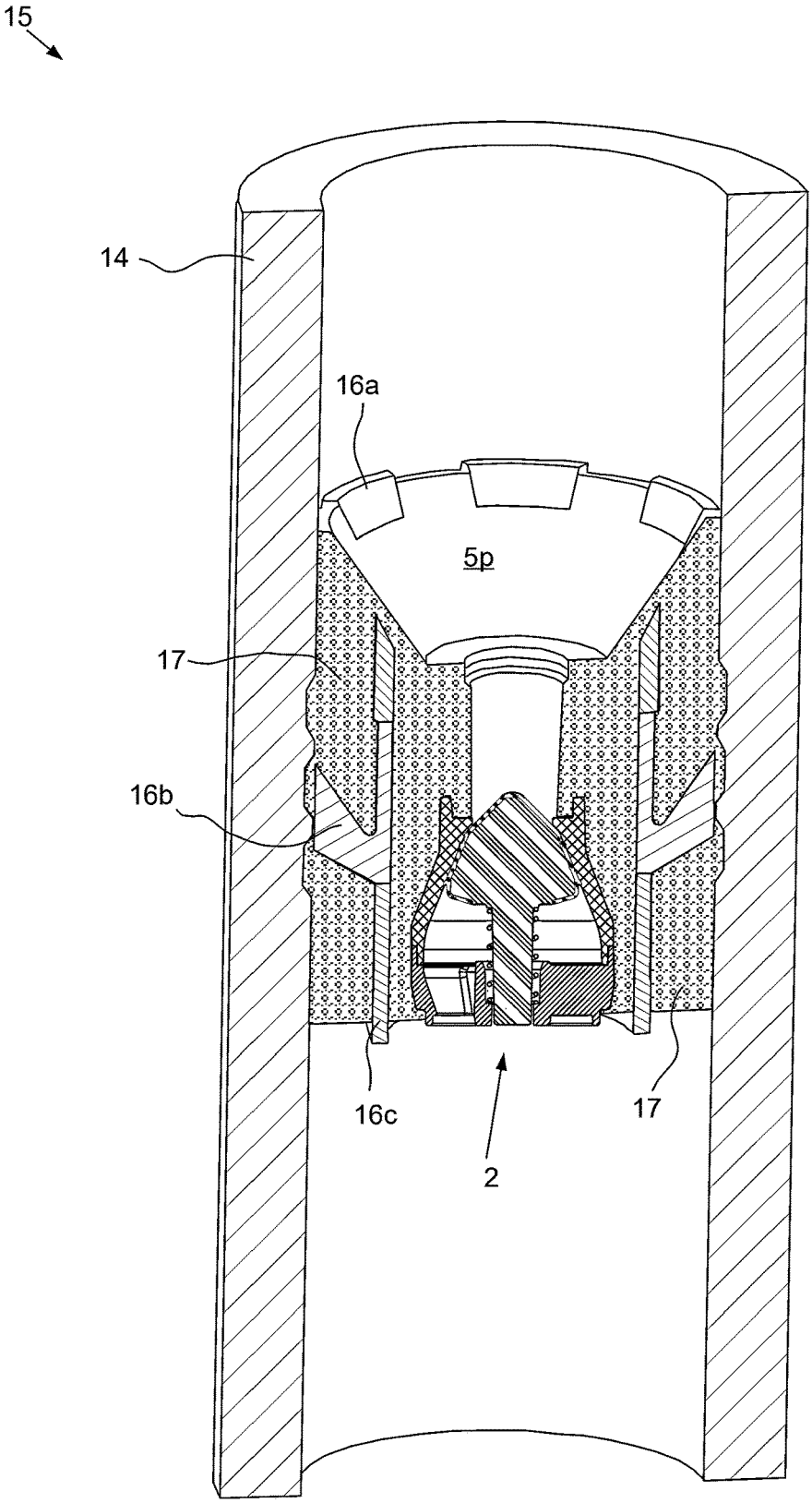
Figure 6A:
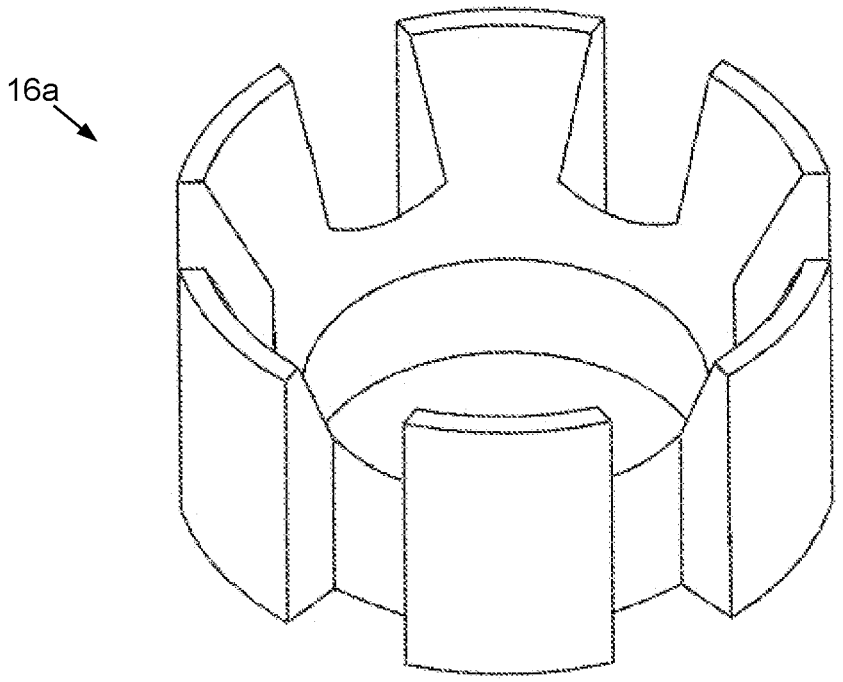
FIGS. 6A, 6B, 7A, and 7B illustrate a guide of the third float collar.
Figure 6B:
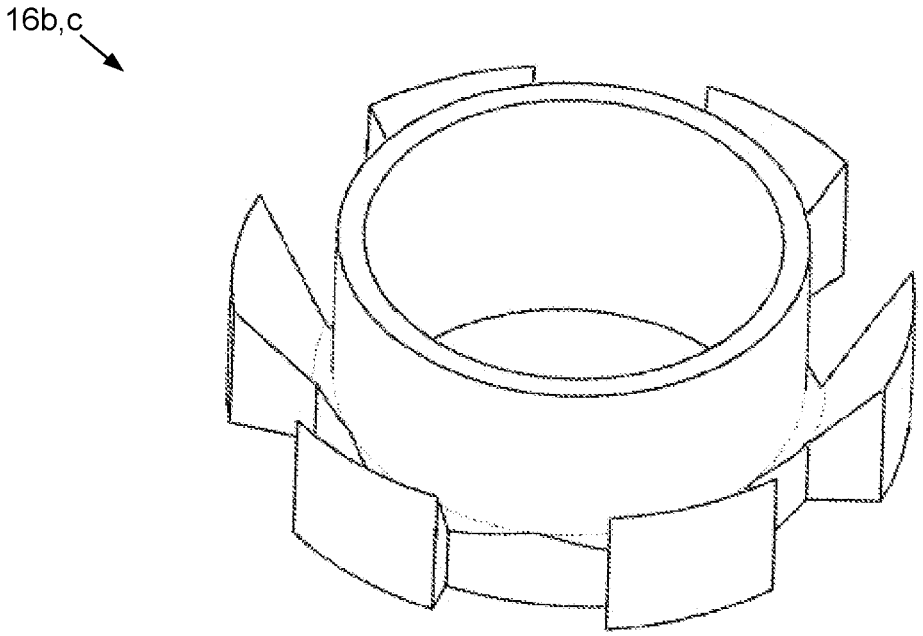
Figure 7A:
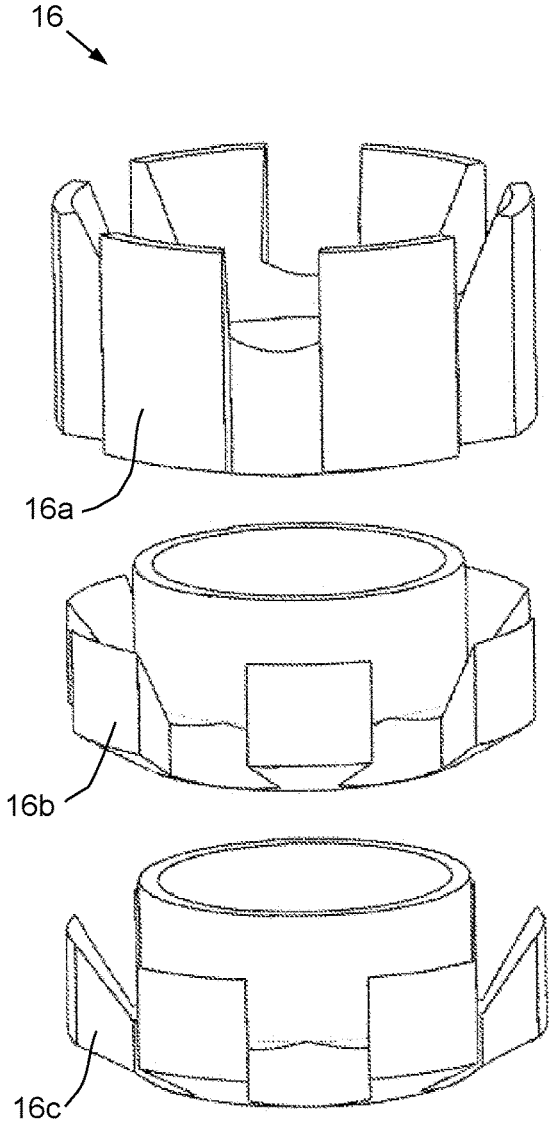
Figure 7B:
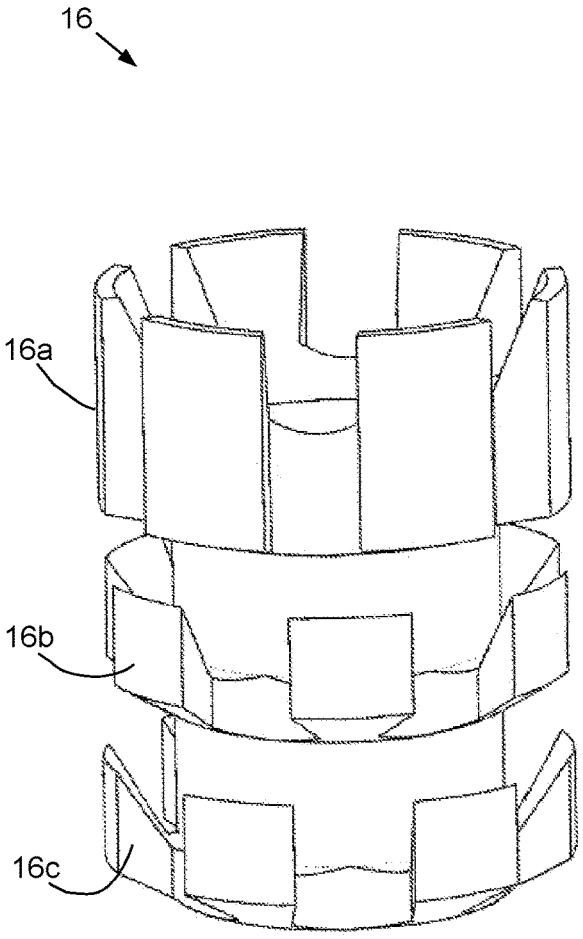

FIGS. 4 and 5 illustrate a third float collar 15 for assembly as part of the composite casing or liner string, according to another embodiment of the present disclosure. FIGS. 6A, 6B, 7A, and 7B illustrate a guide 16 of the third float collar 15. The third float collar 15 may include the float valve 2, a second sheath 17, the second housing 14, and the third guide 16. The second sheath 17 has been omitted from FIG. 4 and is shown in FIG. 5.

The third guide 16 may include a plurality (three shown) of stackable segments, such as an upper segment 16*a*, a mid-segment 16*b*, and a lower segment 16*c*. The mid 16*b* and lower 16*c* third guide segments may be similar or identical. The third guide 16 may be made from a drillable metal or alloy, such as aluminum. Each segment 16*a-c* of the third guide 16 may be annular and have an inner hub portion and an outer ribbed portion. When stacked, the third guide 16 may resemble a tubular member. The third guide 16 may have a length greater than or equal to a length of the second sheath 17. An inner diameter of the third guide 16 may be greater than an inner diameter of the second sheath 17 and an outer effective diameter of the third guide 16 may be about equal to an inner drift diameter of the second housing 14 such that all or almost all of the third guide 16 is encapsulated in the second sheath 17. The ribbed portions of the third guide segments 16*a-c* may be oriented in alignment (not shown) or offset (shown).

The second sheath 17 may be made from cement, such as Portland cement or Portland cement concrete. The second sheath 17 may bond the float valve 2 to the second housing 14 within a flow bore thereof. The second sheath 17 may also bond the third guide segments 16*a-c* together into the tubular-like member. The ribbed portions of the third guide segments 16*a-c* may ensure that the structural integrity of the second sheath 17 is not compromised while providing a firm bond between the third guide 16 and the second sheath. The second sheath 17 may also seal the interface between the float valve 2 and the second housing 14 to prevent fluid bypass of the float valve 2. The second sheath 17 may surround the float valve 2 and have a flow bore formed through a portion thereof and in fluid communication with an upper end port of the float valve 2 and with the flow bore of the housing 4. The float valve 2 may be located in a lower portion of the second sheath 17 such that one or more lower end ports of the float valve are exposed to the flow bore of the second housing 14.

Once encapsulated, the guide profile 5*p* may be formed in and extend from a top of the second sheath 17 and a top of the upper third guide segment 16*a*. The hub portions of the third guide segments 16a-c may prevent the drill bit 18 from side-tracking into the second composite housing 14 while drilling out the second sheath 17 and the float valve 2. An upper surface of each rib of each third guide segment 16*a-c* may be tapered to further discourage side-tracking of the drill bit 18. A landing profile may be formed at an interface between the guide profile 5*p* and the flow bore of the second sheath 17 for receiving a wiper plug (not shown).

Alternatively, the interfacing end portions of the third guide segments 16*a-c* may be castellated to provide torsional connections therebetween. Alternatively, the third guide 16 may be made as one-piece instead of a plurality of segments.

While the foregoing is directed to embodiments of the present disclosure, other and further embodiments of the disclosure may be devised without departing from the basic scope thereof, and the scope of the invention is determined by the claims that follow.

The invention claimed is:

1. A float collar for assembly with a composite string of downhole tubulars, comprising:

a tubular housing made from a composite material and having threaded couplings formed at longitudinal ends thereof;

a float valve disposed in a bore of the housing;

a sheath connecting the float valve to the housing and sealing an interface between the float valve and the housing; and a guide operable to prevent side-tracking of a drill bit into the housing while drilling out the float valve and the sheath and comprising:

a shield disposed adjacent to an inner surface of the housing and made from a non-drillable metal or alloy, wherein:

the guide further comprises a plurality of stacked segments, each segment of the plurality of segments has an inner hub portion and an outer ribbed portion, and a frusto-conical profile formed at a top of the sheath; and the shield is a sleeve lining an inner surface of the housing at an interface between the sheath and the housing.

2. The float collar of claim 1, wherein:

the sheath is made from cement, and each of the housing and the sleeve have an array of cement grooves formed therein.

3. The float collar of claim 1, wherein the shield is made from steel.

4. The float collar of claim 1, wherein a length of the shield is greater than or equal to a length of the sheath.

5. The float collar of claim 1, wherein the composite material is a fiber reinforced polymer.

6. The float collar of claim 1, wherein the float valve comprises:

a body;

a poppet movable relative to the body between an open position and a closed position; and a spring biasing the poppet toward the closed position.

7. The float collar of claim 6, wherein:

the body has a chamber formed therein and a hub adjacent to the chamber, the poppet has a head disposed in the chamber and a stem extending through the hub, the spring is disposed between the body and the poppet, and the float valve is made from a drillable material.

* * * * *